US005263299A

United States Patent [19]

Galbierz et al.

[11] Patent Number: 5,263,299

[45] Date of Patent: Nov. 23, 1993

[54] APPARATUS FOR MANUALLY FORMING CONTAINERS INTO PORTABLE PACKS

[75] Inventors: Richard T. Galbierz; Michael A. Galbierz, both of St. Louis, Mo.

[73] Assignee: Imperial Packaging, Inc., St. Louis County, Mo.

[21] Appl. No.: 935,923

[22] Filed: Aug. 27, 1992

[51] Int. Cl.[5] ..... B65B 27/04; B65B 67/00

[52] U.S. Cl. ..... 53/48.1; 53/48.3; 53/390

[58] Field of Search ..... 53/398, 48.1, 48.3, 53/48.4, 441, 556, 390

[56] References Cited

U.S. PATENT DOCUMENTS

| | | | |
|---|---|---|---|
| 2,929,181 | 3/1960 | Poupitch | 53/48.4 X |
| 2,995,272 | 8/1961 | Larson | 53/48.1 X |
| 3,242,631 | 3/1966 | Whiteford | 53/48.1 X |
| 3,628,305 | 12/1971 | Owen et al. | 53/48.4 X |
| 3,680,279 | 8/1972 | Picq | 53/48.4 X |
| 3,859,773 | 1/1975 | Calvert et al. | 53/48.1 |
| 4,649,690 | 3/1987 | Schiesz et al. | 53/48.4 |

*Primary Examiner*—Horace M. Culver

*Attorney, Agent, or Firm*—Polster, Lieder, Woodruff & Lucchesi

[57] ABSTRACT

Manually operated apparatus for assembling a multi-container pack in a carrier wherein the apparatus has a base formed with apertures in a pattern to form a multi-container pack, a carrier supported on the base and it being formed with a pattern of container receiving apertures having bendable fingers ringing the inner circumference of the container apertures, and a container guide positioned over the carrier for steering the containers into positions with the ends thereof grasped by the fingers ringing the ends of the containers.

5 Claims, 2 Drawing Sheets

APPARATUS FOR MANUALLY FORMING CONTAINERS INTO PORTABLE PACKS

BACKGROUND OF THE INVENTION

1. Field of the Invention

The present invention relates to apparatus for assembling containers into portable packs by manual operation.

2. Description of the Prior Art

In U.S. Pat. No. 5,125,506 there is described a carrier for multiples of flanged containers, the carrier comprising a sheet of paperboard containing apertures for receiving the containers, said apertures being surrounded by radial slits to form fingers by which a container is retained in an aperture. That invention offers biodegradable packaging as well as certain economic advantages.

To meet the economic and environmental objectives of using a minimum of material, the fit of containers in a carrier is of precision comparable to the precision of container dimensions. Because of this precision fit of containers in the carrier, it is thought to be impractical to insert containers by hand; however there is a need for a hand operated machine for attaching a handy carrier to a group of containers which is intended to provide a low volume handy container pack machine having a reduced complexity of features that will be peculiar to a manually-operated machine. One form of a low volume machine selected for description is not intended to be restricted as other forms may include means which accomplish the unique functions described.

BRIEF DESCRIPTION OF THE INVENTION

The embodiment to be described presently is exemplified by a unique cooperative hand manipulated item of apparatus which will satisfy the marketing of hand packed canned beverages by low volume merchants.

The preferred apparatus embodies means for supporting a carrier in a preselected position to receive groups of containers in which the containers are placed in an open end down position and in which the apparatus receives the manual positioning of the containers so as to obtain proper engagement on the carrier.

It is the further object of the present invention to utilize the carrier means disclosed in U.S. Pat. No. 5,125,506, issued Jun. 30, 1992 for making up a handy pack of containers on such a carrier so as not to damage the supporting connection between the carrier and a pack of containers.

BRIEF DESCRIPTION OF THE DRAWINGS

The invention is shown by apparatus that is set forth in the accompanied drawings wherein.

DETAILED DESCRIPTION OF THE EMBODIMENT

Figure 3:
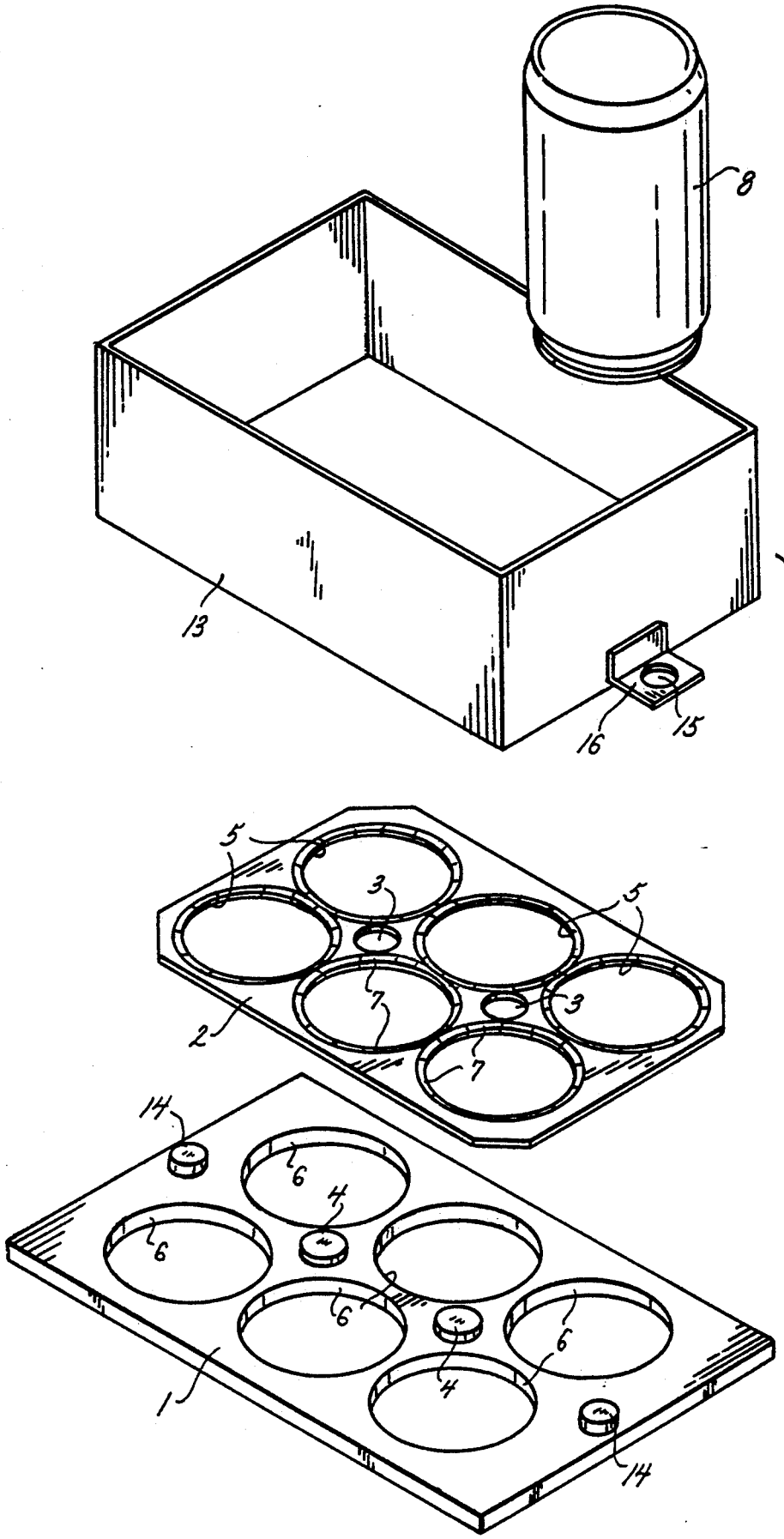
FIG. 3 is an exploded view illustrating the several components of apparatus which are necessary to the formation of a pack of containers.

As illustrated in FIG. 3, a paperboard carrier blank 2 is laid onto a base 1 with carrier finger holes 3 registered on pins 4 in the base 1 to align the apertures 5 in the blank 2 concentrically upon holes 6 in the base. The diameter of holes 6 is chosen to allow the fingers 7 surrounding apertures 5 to flex downwardly in the holes 6 and admit the ends of containers 8 while supporting the surrounding area of the rest of blank 2. The thickness of base 1 is selected to limit the penetration of the ends of containers 8 to that which is necessary to allow fingers 7 to first flex sufficiently to pass the chimes 9 of the containers 8 sufficiently to have the fingers 7 snap under the chimes 9 of containers 8 which almost abut the support surface 10 without permitting the tapering surface or shoulders 11 of containers 8 to bear on the fingers 7 at their base and possibly distort them. The bending of fingers 7 too severely will adversely affect their intended function of retaining containers. Containers 8 are formed into appropriate groups or packs 12 by being manually loaded, neck down (see FIG. 3), into a chase or guide 13 which is held in correct location in relation to the blank 2 by pins 14 on base 1 engaging holes 15 at either end on guide 13. When the correct number of containers is placed in the chase or guide 13, the chase or guide constrains the containers to assume positions to line up with the apertures 5 of blank 2 and apertures 6 in the base 1.

It is well illustrated in the exploded view of FIG. 3 that the base 1 of the apparatus is formed with a plurality of locator elements 4 which are intended for locating the finger holes 3 of the carrier blank 2, and other locator elements 14 for positioning the chase or guide 13 on the base 1 through the use of tabs 16 on the chase or guide 13 which drop over the locator elements 4 on the base 1. In addition to the several locators 4 and 14, the series of apertures 6 have a depth equal to the thickness of the base 1. In this instance, base 1 is formed of plate material having a thickness of ¼", and the apertures 6 are closed by a work surface 10 on which the base 1 is placed.

Figure 2:
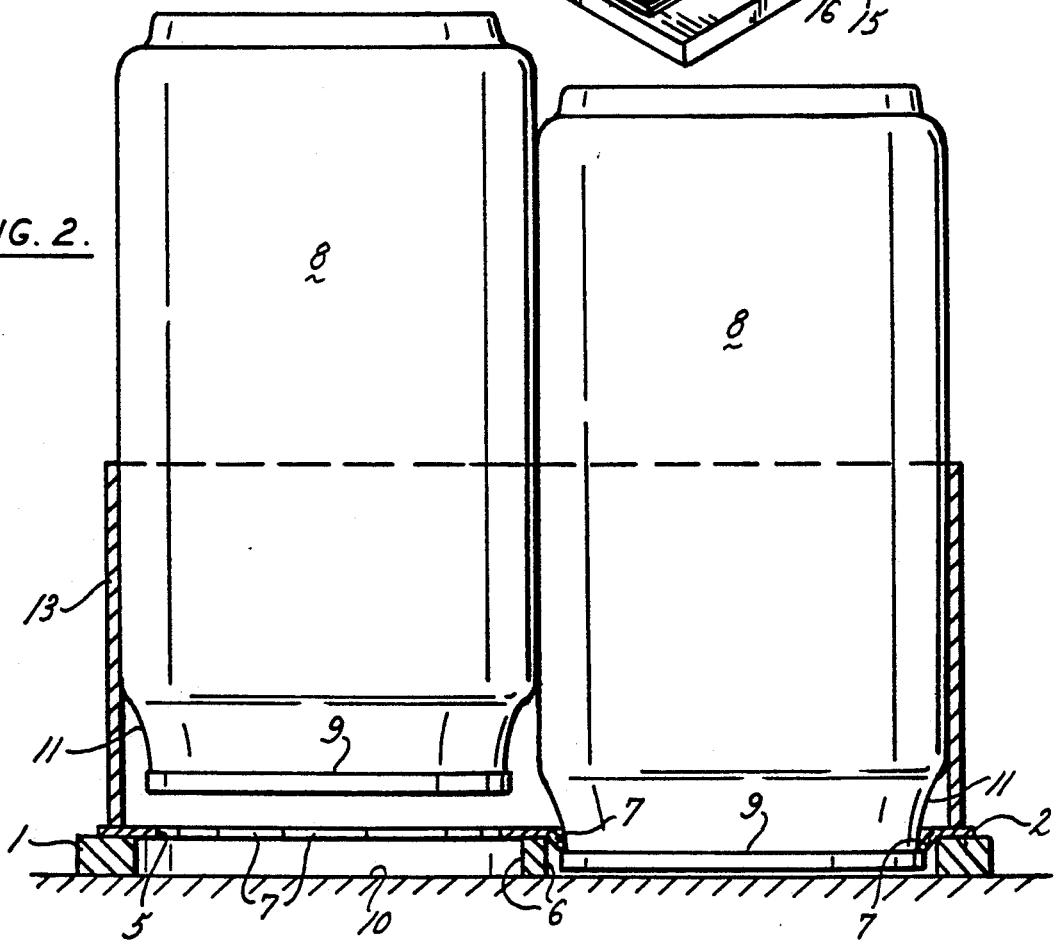
FIG. 2 is a section view taken along line 2—2 in FIG. 1 showing the response of the carrier apertures to the approach of a typical container and the capture of the container end.

It is observed that each aperture 5 of the carrier blank 2 has an internal diameter which is smaller than the diameter of the opening 6 in the base 1, and the internal circumference of each aperture 5 has been formed with a plurality of radially inwardly directed fingers 7 so that the initial inner diameter of the apertures 5 can be expanded upon the insertion of the tapering end 11 of a container 8, as is illustrated in FIG. 2. The thickness of the plate of the base 1 and the size of the apertures 6 therein are intended to allow each container 8 as its chime 9 is aligned with an aperture 5 of the carrier blank 2 to enter for the purpose of flexing the fingers 7 to allow passage of the container end chime 9 so that the fingers 7 may flex to pass a container rim or chime 9 and then snap backwardly toward the initial position and engage the chime 9 of the container end for rendering a group of containers carryable by means of the carrier blank after it has received a complement of containers.

Figure 1:
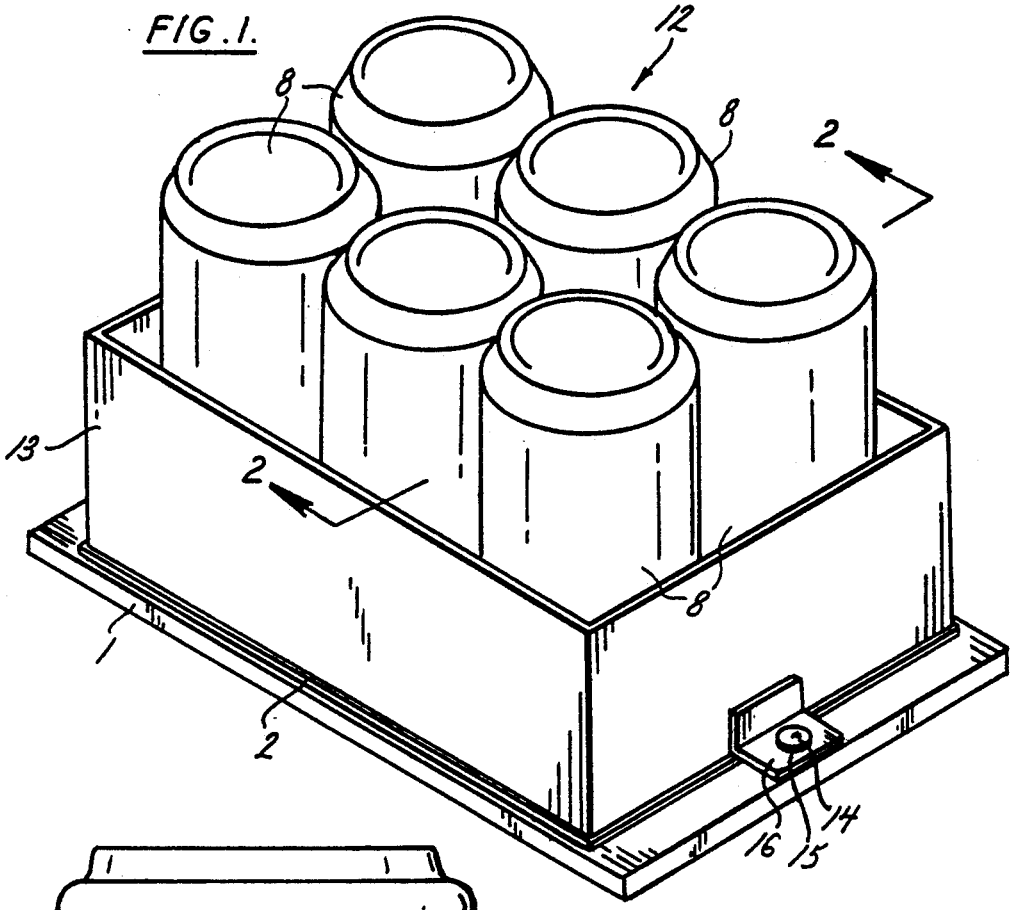
FIG. 1 is a perspective view of the apparatus showing a pack of containers manually assembled in an upside down position.

Containers 8 are inserted seriatim into the chase or guide 13 by manual application of force, e.g., by a bump from the heel of the operator's hand or by a similar force by a gloved hand. The peak force reguirement to begin bending the fingers 7 is in the range of 20 pounds. After the fingers 7 begin to flex, the resisting force drops dramatically, so that a manual push of small momentum accomplishes the insertion. As the containers 8 are moved into position, the fingers 7 are depressed which could cause the carrier blank 2 to curve upwardly. However, the insertion of the containers is accomplished after the chase 13 has been secured by the tabs 16, and the lower margin of the chase is held down on the margins of the blank 2 to prevent that curling effect. The margin of the blank 2 is seen in FIGS. 1 and 2 to project out from under the lower margin of the chase 13.

In this disclosure, and only as an example because container dimensions can change, the aperture 6 in the base plate 1 has a diameter of 2 7/16 inch, and the aperture 5 in the carrier 2 is about 1⅞ inch. The difference is about 7/16 inch which makes the length of fingers 7 each about 7/32 inch. As the container chime 9 begins to push down on the fingers 7, those fingers must pivot around the circumferential inner edge of the aperture 6. However, the fingers bend into a curved form which allows the diameter of the opening between opposed fingers 7 to expand until the chime 9 on the container is able to pass the fingers 7 before the container shoulder surface 11 can move to press on the base line of fingers 7 and cause the paperboard of the carrier 2 to take on a sharp bend type deformation that would prevent spring back of the fingers 7 toward the initial unbent attitude. It is believed that the curving reaction of the fingers 7 allows the chordal spacing between fingers 7 to expand sufficiently to allow passage of the container chime 9 through the base plate aperture 6 to abut on the supporting surface 10 for the base 1. The bending of the paperboard usually causes an upward curling reaction of the paperboard. The prevention of the curling is obtained by allowing the margins of the chase 13 to abut or press down on the margins as shown in FIGS. 1 and 2. After all containers are positioned in the aperture 5 of a carrier board 2, the guide 13 can be removed to allow removal of the carrier mounted pack of containers.

The foregoing disclosure has set forth a preferred form of the invention, however it is understood that the invention may be practiced otherwise than as specifically described.

What is claimed is:

1. Apparatus for assembling containers in a pack held together in a carrier having container receiving apertures, each aperture being surrounded by container retaining means, said apparatus comprising:

a) a support having a surface presented to containers and formed with apertures substantially matching the carrier apertures; and b) guide means positioned on said support surface to surround said apertures formed therein, said guide means being adapted to position containers to assume positions aligned on the carrier apertures for manual passage through the container receiving apertures permitted by said substantially matching apertures in said support.

2. The apparatus set forth in claim 1 in which said support is formed with locator means to locate container carriers in position to align the carrier apertures with said substantially matching apertures in said support.

3. The apparatus set forth in claim 1 in which said support has a thickness sufficient to allow penetration of containers a distance to allow the container retaining means to yieldably pass the container into a support aperture.

4. The apparatus set forth in claim 1 in which said guide means rests on the carrier to retain the carrier in position against flexing as containers are directed into said support apertures.

5. The apparatus set forth in claim 2 in which said guide means is provided with means to removably engage on certain of said locator means.

* * * * *